US005991564A

United States Patent [19]

Ni

[11] Patent Number: 5,991,564

[45] Date of Patent: Nov. 23, 1999

[54] ELECTROPHOTOGRAPHIC DUPLEX PRINTING MEDIA SYSTEM

[75] Inventor: Beta Y. Ni, Sherwood, Oreg.

[73] Assignee: Tektronix, Inc., Wilsonville, Oreg.

[21] Appl. No.: 09/165,686

[22] Filed: Oct. 2, 1998

[51] Int. Cl.[6] ..... G03G 15/20; H05B 1/00

[52] U.S. Cl. ..... 399/69; 219/216; 399/324; 399/328

[58] Field of Search ..... 118/60; 219/216, 219/469, 492; 399/328, 330, 331, 324, 69, 320, 325, 329; 432/60

[56] References Cited

U.S. PATENT DOCUMENTS

| | | | |
|---|---|---|---|
| 4,046,471 | 9/1977 | Branham et al. | 355/14 |
| 4,101,686 | 7/1978 | Strella et al. | 427/22 |
| 4,234,180 | 11/1980 | Looney | 271/3.1 |
| 4,272,181 | 6/1981 | Treseder | 355/14 |
| 4,334,765 | 6/1982 | Clark | 355/14 |
| 4,348,101 | 9/1982 | Schonfeld et al. | 355/14 |
| 4,453,841 | 6/1984 | Bobick et al. | 400/126 |
| 4,475,128 | 10/1984 | Koumura | 358/296 |
| 4,879,571 | 11/1989 | Plasscheart | 355/26 |
| 4,881,132 | 11/1989 | Lajos | 358/296 |
| 5,247,336 | 9/1993 | Mills, III | 399/70 |
| 5,541,030 | 7/1996 | Sano et al. | 430/106.6 |
| 5,764,245 | 6/1998 | Yokoi | 347/16 |
| 5,764,263 | 6/1998 | Lin | 347/101 |
| 5,772,343 | 6/1998 | Beretta et al. | 400/624 |
| 5,790,766 | 8/1998 | Sakamoto et al. | 395/113 |

*Primary Examiner*—William Royer
*Assistant Examiner*—Hoang Ngo
*Attorney, Agent, or Firm*—Ralph D'Alessandro; Charles F. Moore; Francis I. Gray

[57] ABSTRACT

A method and system media sheet handling in an electrophotographic color desktop printer are disclosed wherein a media sheet is imaged with toner on both sides of the media sheet without smudging or remelting the images. The temperature of the fusing roller and the pressure roller are controlled to keep the pressure roller temperature below the toner cold offset temperature.

6 Claims, 4 Drawing Sheets

ELECTROPHOTOGRAPHIC DUPLEX PRINTING MEDIA SYSTEM

BACKGROUND OF THE INVENTION

This invention relates generally to a method and a system for printing on two sides of a media sheet, and more particularly, to the fusing temperature settings for an electrophotographic media handling system which first feeds a media sheet with a first side exposed to a print source, then feeds the media sheet with a second side exposed to the print source.

Printing to two sides of a media sheet, referred to as duplex printing, is a desirable feature in printing systems, especially in desktop or office color printers as printing speeds increase. The advantages of duplex printing include reducing the amount of paper required compared to one-sided (simplex) printing, and generating print sets with layouts resembling that of professionally printed books. Conventional duplex printing devices employ complex paper handling mechanisms. Typically, an extra tray is used for temporary storage of pages having printing on a first side. In an alternative approach a second paper path is provided to route a first printed page around the existing paper supply. Another approach utilizes a media re-feed guide that positively blocks the movement of media along a first path of travel and directs the media travel along a second path.

Similarly, duplex copying typically is accomplished by either one of two methods. In one method, first side copies are stacked in a duplex tray. When a set of first side copies is complete, the copies are fed out of the duplex tray and returned with an odd number of inversions along a duplex path to receive second side imaging. In an alternative method first side copies are returned directly to receive second side imaging without stacking.

The development of good quality color electrophotographic desktop printers has accelerated the acceptance of color printing and has spawned interest in being able to duplex print electrophotographic output. Because electrophotographic printing with toner requires fusing of the image to the final receiving substrate, duplex printing presents the problem of how to fuse the image on the second side of the final receiving substrate without melting and offsetting or lifting off the image on the first side of the substrate. Duplex printing with solid ink has a similar hurdle. Solid ink printing employs a wax-like ink base that is jetted at a molten temperature and then solidifies as it cools on intermediate and final receiving substrates. Printing on the second side of a media sheet without melting or destroying the hardened image on the first side has been a barrier to duplex printing. Paper curling has also been a problem.

Conventional approaches to achieve duplex printing have employed long paper paths, multiple imaging units, and many parts including additional temperature sensors and cooling devices. It is desirable to achieve a method and system for duplex printing in an electrophotographic desktop printer employing color toners in a single multi-color imaging unit. These problems are solved in the design of the present invention.

SUMMARY OF THE INVENTION

It is an aspect of the present invention that a simple desktop printer duplexing method and system are provided to achieve duplex printing in an electrophotographic desktop color printer.

It is another aspect of the present invention that the simple duplex printing apparatus and system are usable in a color electrophotographic desktop color printer.

It is a feature of the present invention that the temperature of the heated fuser roller is controlled to prevent toner melting on the first side of the imaged final receiving substrate and offsetting onto the pressure roller during fusing of the image onto the second side in the duplex printing mode.

It is another feature of the present invention that the glass transition temperature of the toner is not approached by keeping the fuser temperature sufficiently low and the pressure roller temperature at a temperature below the toner cold offset temperature or the temperature below which toner is not fused.

It is still another feature of the present invention that the use of a multi-functional oil on the fusing roller permits the use of a low fusing temperature without sacrificing image quality and image grade.

It is yet another feature of the present invention that the temperature of the pressure roller during duplex printing operation is at least about 5° Centigrade below the toner cold offset temperature in the same fusing system.

It is an advantage of the present invention that the apparatus and method are relatively simple and low in cost, but still enable high speed desktop duplex printing to be accomplished.

It is another advantage of the present invention that there is no need for any special cooling devices to reduce the temperature of the pressure roller.

It is still another advantage of the present invention that the duplex printing method and apparatus does not degloss or melt or offset the toner first side image while accomplishing the second side imaging and fusing.

These and other aspects, features and advantages are achieved in a duplex printing system utilized in an offset solid ink desktop printer to accomplish rapid, low cost, and high quality duplex printing.

BRIEF DESCRIPTION OF THE DRAWINGS

These and other aspects, features and advantages of the invention will become apparent upon consideration of the following detailed disclosure of the invention, especially when it is taken in conjunction with the accompanying drawings wherein.

DETAILED DESCRIPTION OF THE PREFERRED EMBODIMENT

Figure 1:
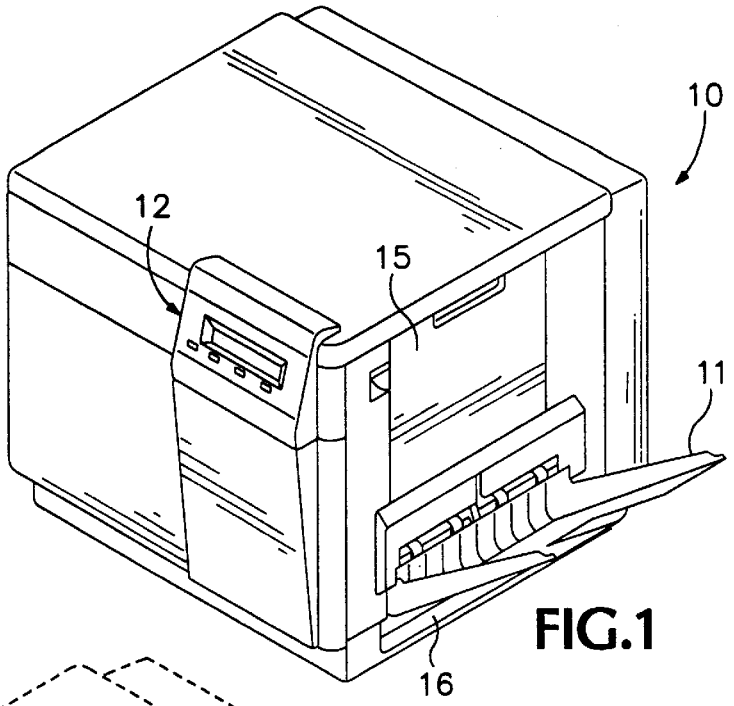
FIG. 1 is a front perspective view of the desktop electrophotographic color printer utilizing the present invention.

FIG. 1 shows the desktop printer indicated generally by the numeral 10 which has a media output area 11 for receiving and holding a plurality of completed image outputs. An operator front panel permitting the operator to select certain operating features and to obtain feedback information as indicated generally by the member 12. A media path toner cartridge access cover 15 is hingedly affixed to the front of the printer 10 to permit access to the paper path and viewing of the media handling apparatus. A removable media tray 16 is positioned beneath the media output area 11 to provide the desired media for the use of the printer.

Figure 2:
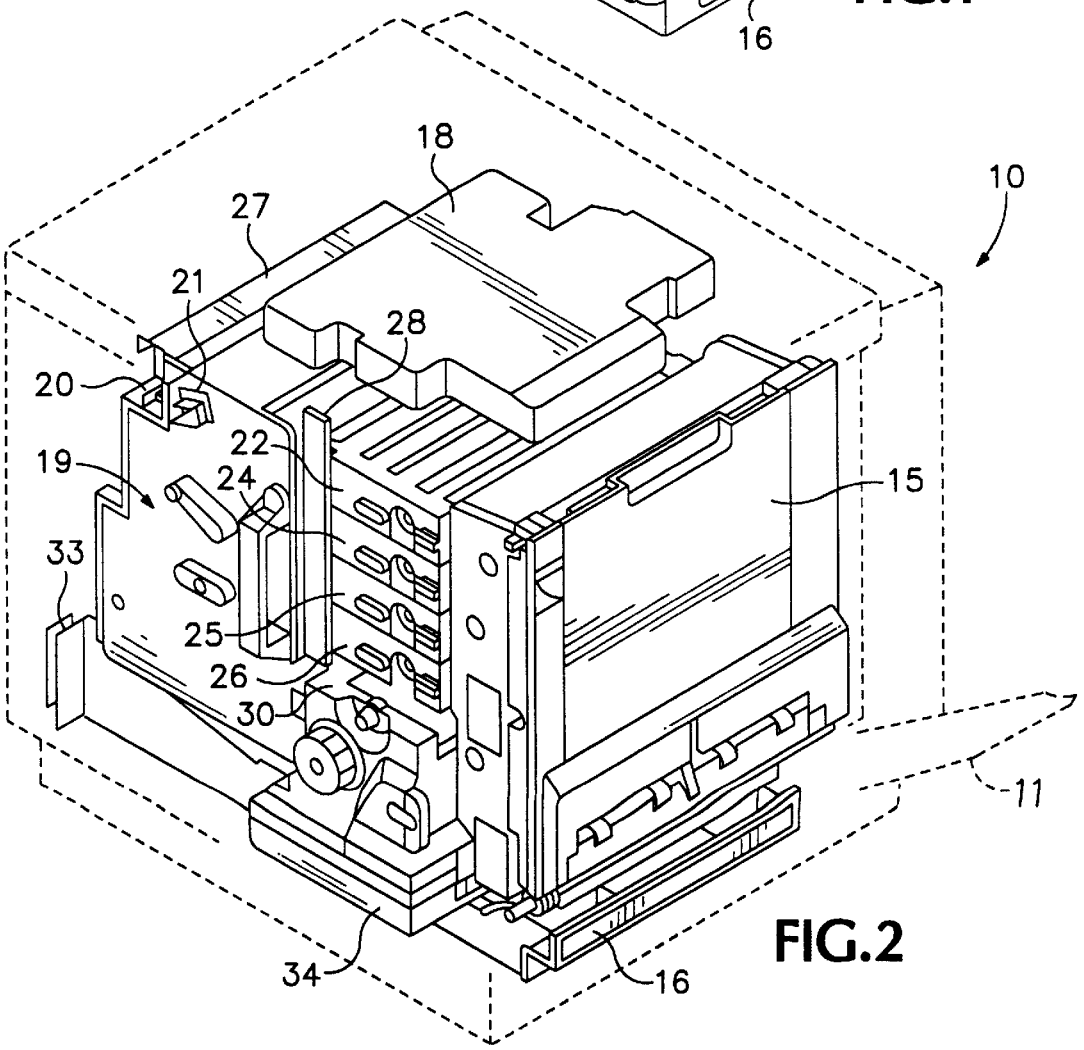
FIG. 2 is a side perspective view of the desktop electrophotographic color printer of FIG. 1 with the covers and sides removed.

Looking now at FIG. 2, there are shown in a side perspective view some of the operative parts of the printer 10 which are employed in the electrophotographic imaging of a media sheet as it passes through the printer. A laser scanner 18 sits atop the unit overlying the photo conductor (not shown). The imaging unit is indicated generally by the numeral 19 and underlies the scanner 18. Imaging unit 19 is removably slidable out of the printer 10 and includes detailed components discussed in greater detain in FIG. 3. The multiple toner cartridges are indicated by black cartridge 22, cyan cartridge 24, magenta cartridge 25, and yellow cartridge 26. A toner level sensor board 28 enables feedback on the remaining amount of toner in the cartridges to be provided. A fuser assembly 34 underlies the toner cartridges and a pre-transfer lamp 30. A media feed guide 33 is at the rear of printer 10 to guide the individual media sheets 29, seen generally in FIG. 3 from the media tray onto the path to a accumulator belt 32 seen in FIG. 3.

Figure 3:
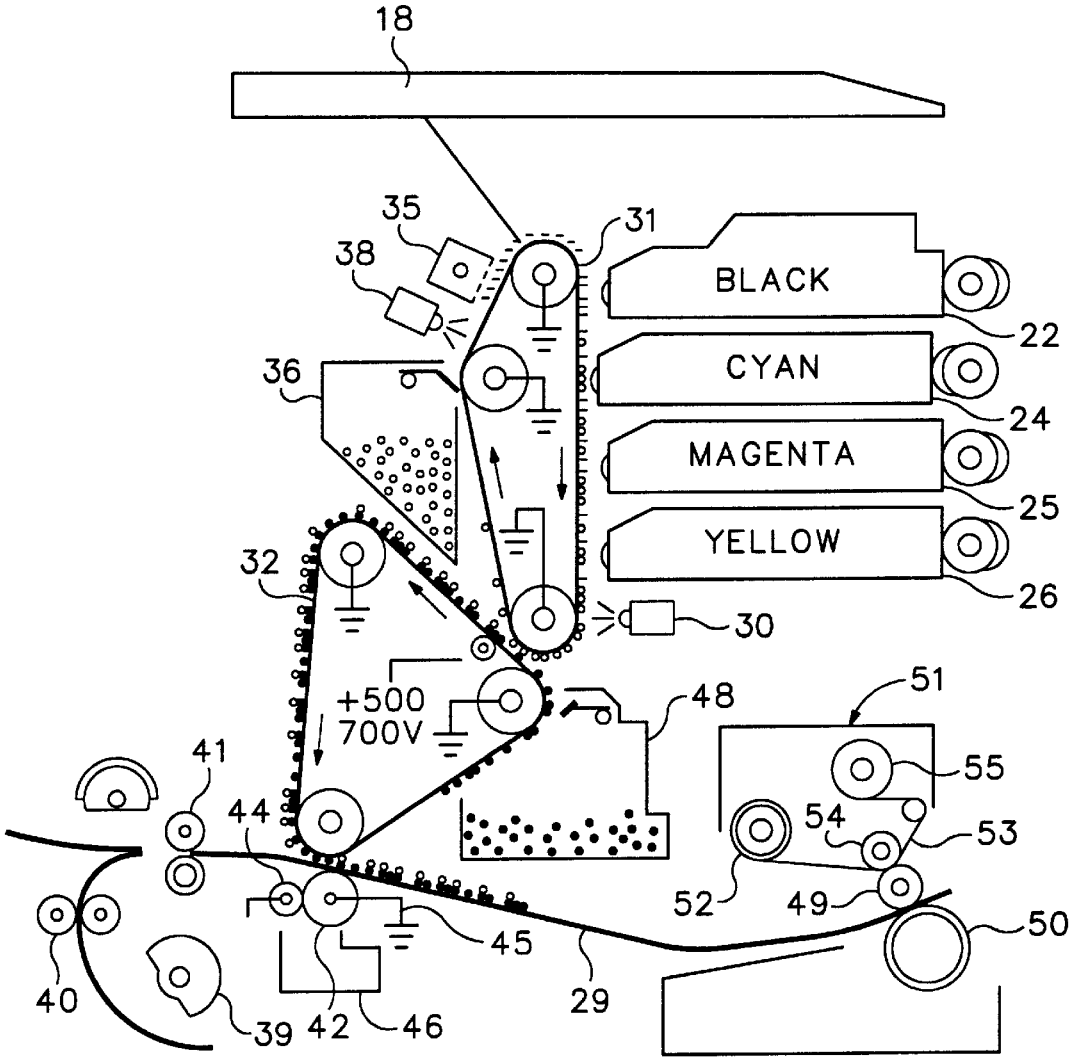
FIG. 3 is a diagrammatical illustration in side elevational view of the imaging, fusing an media handling subsystems of the desktop electrophotographic color printer of FIG. 1.

Looking now at FIG. 3, a diagrammatic illustration shows in greater detail the imaging unit 19 that includes a photoconductor, which in this instance is a belt 31, that underlies the laser scanner 18. A corotron charger 35 applies a charge to the photoconductor prior to the scanner. Toner is then applied individually from the selected one of the toner cartridges 22, 24, 25, and 26 to the belt 31 while it is tensioned between the idlers as shown. A pre-transfer lamp 30 heats the toner to prepare it for transfer to the accumulator belt 32. The accumulator belt 32 will have additional colored toners applied to accumulate the total image prior to transfer to the media sheet 29. After the initial transfer of toner from photoconductor belt 31, any untransferred toner is removed by a photoconductive belt cleaner 36 and any residual charge remaining on the photoconductor an erase by the erase lamp 38. The belt is then charged again by charger 35, imaged by the laser scanner 18 and developed by the application of the selected toner from the cartridges 22, 24, 25, 26. The process is completed when the four color image is accumulated on the accumulator belt 32. Belt 32 has a bias applied to it via biasing rollers to insure the toner particles are retained as the belt rotates about the guide and biasing rollers.

A media sheet 29 is initially removed from the media tray 16 by pick roller 39 and is guided past the media guide 33 by intermediate rollers 40 to aligning rollers 41. Alternatively, a different media sheet from that in media tray 16 can be fed by alternative media pick roller 37 from a media tray (not shown) into aligning rollers 41. The media sheet 29 is then passed through the transfer nip formed between a bias transfer roller 42 and the accumulator belt 32. A transfer roller 44 applies an initial voltage to the bias transfer roller 42 which can receive additional voltage from a voltage source 45 depending on the media being employed and the relative humidity of the ambient air. Waste toner bins 46 and 48 collect toner particles from the media sheet 29 and the accumulator belt 32, respectively. A heated fuser roller 49 applies heat and, in combination with pressure roller 50, pressure to the media sheet to fuse the toner image onto the media sheet 29 as the sheet passes there between. An oiling assembly is indicated generally by the numeral 51. This includes an application roller web 53 that is impregnated with an amino mercapto silicone blended oil and is controlled by the pressure roll assembly indicated generally by numeral 51. Assembly 51 includes a supply roller 52, a contact roller 54, web 53 and a takeup roller 55 that retrieves the web 53 after it has been pressed against the exterior of fusing roller 49.

Figure 4:
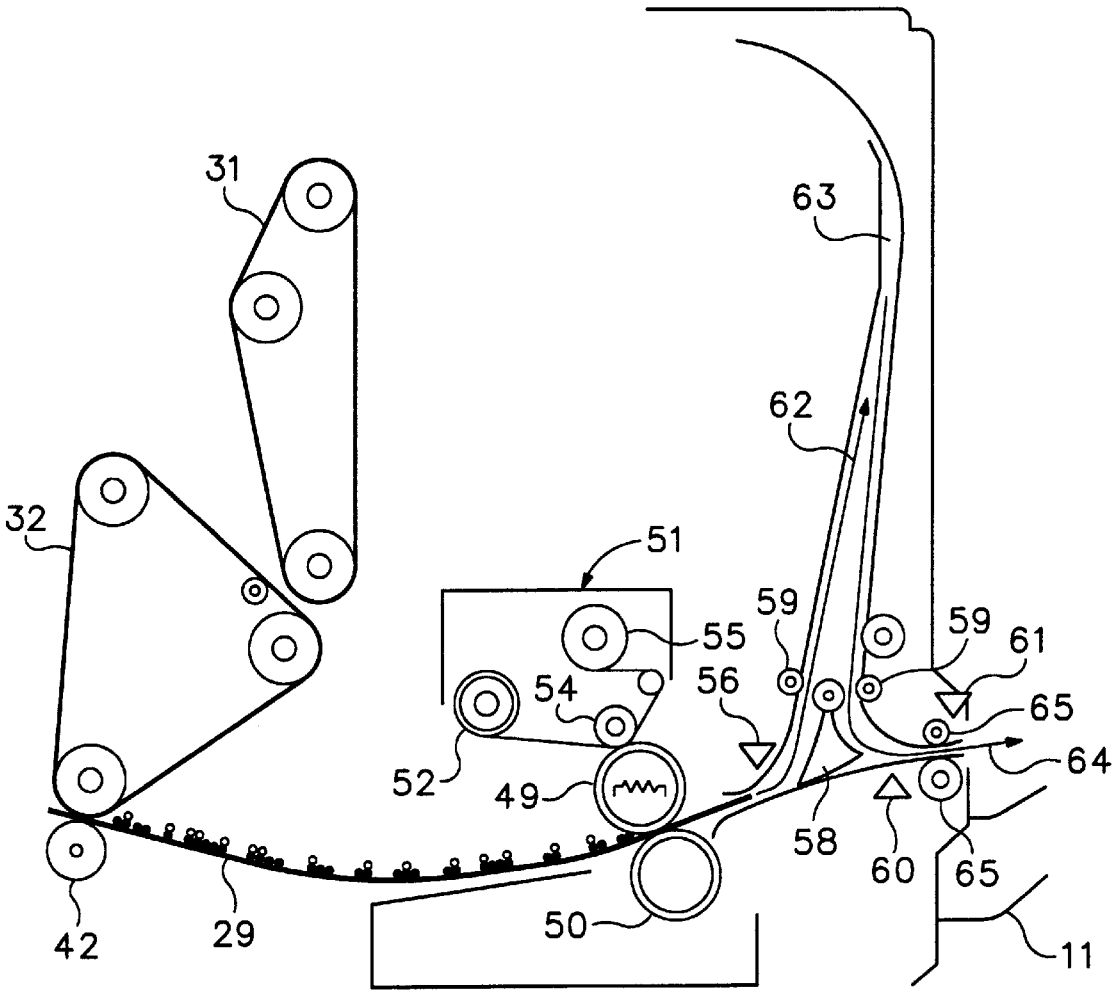
FIG. 4 is an enlarged diagrammatical illustration in side elevational view of the desktop electrophotographic color printer of FIG. 1 showing the fuser assembly and the media path for duplex printing.
Figure 5:
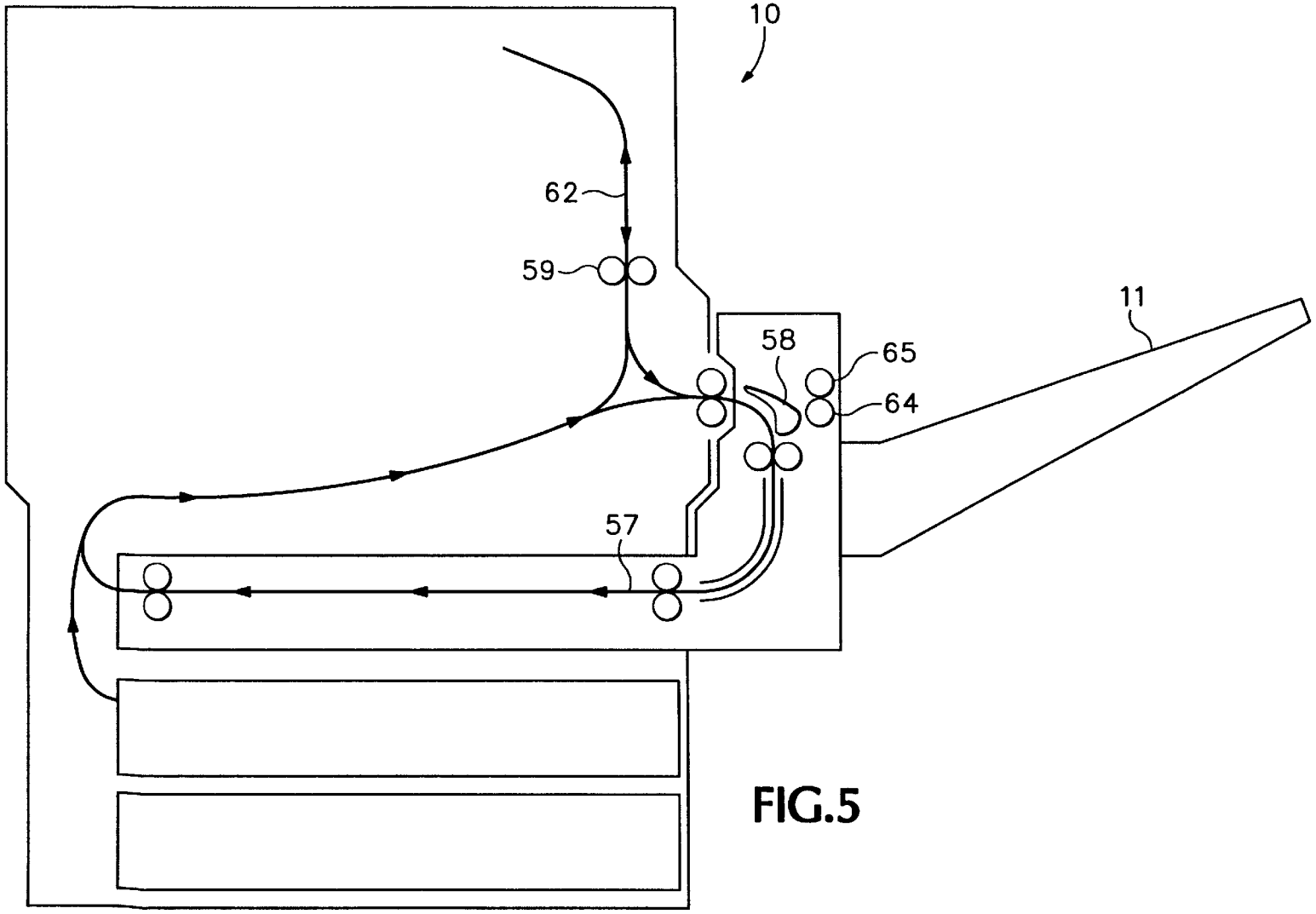
FIG. 5 is a diagrammatical illustration of the media path used for duplex printing.

FIG. 4 shows in diagrammatic illustration the media path for duplex printing, as does FIG. 5. As seen in FIG. 4, the media sheet 29 passes between the fusing roller 49 and the pressure roller 50 and, in the duplex mode, is guided by the closing of duplex solenoid gate 58 upwardly along path 62 indicated by the arrow. Since the printer controller has received the command for duplex printing, the reverser switch 63 is contacted and activates the reverse rollers 59 to return the media sheet 29 downwardly into the duplex path 57 of FIG. 5 that goes through the media tray 16 enroute to the image transfer station at the nip between biasing roller 42 and accumulator belt 32 and through the fusing roller 49 and pressure roller 50 to receive and fuse a duplex image on the second side in the manner previously described. When the duplexed image sheet has passed through the fusing roller 49 and pressure roller 50 and contacted the reverser 63, the reverser rollers 59 are activated and transport the duplexed image media sheet 29 out along path 64 past the exit sensor 60 and the media output tray sensor 61 into the output tray 11.

In simplex printing, the duplex solenoid gate 58 is raised and the imaged media sheet 29 passes directly outwardly through the exit roller 65.

The invention uses a coating on the fusing roller 49 that is a mixture of functional polymeric release agents to provide better releasability than an individual functional release agent used alone to interact with the base member of the fusing roller. The functional polymeric release agents that have been shown to be effective to inhibit toner offset when used alone are those polymeric release agents that have a functional group select from hydroxy, epoxy, carboxy, amino, isocyanate, and mercapto. By blending a mixture of these agents properly, the mixture offers toner releasability to a base member or fuser member with a wide range of elastomeric layer materials and toners of various chemical compositions. The suitable mixture will chemically bind to available binding sites on the base member surface of roller 49 and inhibit toner/base member interacting. Specifically, a mixture of mercapto- and amino-functional release agents, such as about a 0.05%:0.18% weight ratio of mercapto-functional and carbinol-functional release agent on the fluoropolymer fusing roller base member will optimize the duplex printing results. The polymeric functional release agents preferably employed in the practice of the present invention are mercapto-functional oil with 0.1% —SH functionality, available commercially from Wacker Silicones Corporation, and carbinol-functionality with 0.355% —OH functionality, available commercially from Genesce Polymers Corporation of Flint, Mich. The multi-functional oil employed on the fusing roller in the printer utilizing the present invention is described in greater detail in U.S. patent application Ser. No. 08/831,990 entitled "Fusing Apparatus Employing Multi-Functional Toner Release Agents", filed Apr. 1, 1997, assigned to the assignee of the present invention and which is hereby specifically incorporated by reference in pertinent part. This multi-functional oil obviates the need for a separate cooling device for the pressure roller 50 because the oil permits a lower fusing roller temperature to be employed without problematic toner offsetting or print quality degradation occurring, especially during duplex printing.

The media sheet 29 passes out between the exit rollers 65 in simplex printing all the way into the media output area 11. When duplex printing is selected, the printer controller (not shown) signals the printer to close the duplex solenoid gate 58. Reverser switch 63 signals to reverse the reverser rollers 59 when the media sheet 29 has completed its timed travel upwardly. Upon signal, the printer controller (not shown) reverses the direction of rotation of the reverse rollers 59 to guide the media sheet 29 back into the printer media tray 16 and along the duplex media path indicated by the arrow 57. The media sheet 29 is drawn back into the printer along the duplex path of travel 57 that automatically reverses the media sheet 29 so that the trailing edge of the media sheet 29 becomes the leading edge during the imaging of the second side of the media sheet 29.

Key to being able to duplex image a media sheet 29 in the printer 10 is the control of the temperature of the media sheet 29 and the various heating apparatus after the simplex imaging has occurred with the placement of the toner layer on the surface of the media sheet 29 or final receiving substrate and the substrate's subsequent duplex imaging on its second side and passing through the fuser assembly. Media sheet 29 is recommenced along its duplex media path 57 by the reversing of the reverse rollers 59. To avoid remelting or smudging the simplex imaged side of the media sheet 29, the temperature of the fusing roller 49 and the pressure roller 50 must be controlled so that the temperature is not elevated sufficiently high to remelt the toner image on the first side of the media sheet 29. For example, prior electrophotographic printers operated the with the fuser temperature at about 160° C. at a 48 millimeters per second processing speed for coated paper. The instant printer 10 operates with a fuser temperature of between about 150° C. and about 162° C. and a processing speed of about 55 millimeters per second and for coated paper at about 153° C. In the present invention, the pressure roller 50 temperature during duplex printing operation is kept at least 5° C., and more preferably at least about 10° C., and most preferably at least about 15° C., below the toner cold offset temperature in the particular printing mode employed. The toner cold offset temperature is a function of the media type employed, the processing speed, and the type of toner used. These same factors will also affect the desired fusing temperature. In the present invention a polyester-based toner is employed.

While the pressure roller 50 is not actively heated by a separate heating element, the temperature of the pressure roller 50 will elevate through contact via the media sheet 29 with the fusing roller 49. This temperature range provides sufficient heat to fuse the toner image without permitting the temperature of the unheated pressure roller 50 from elevating to a temperature that causes the toner in the image on the first side of the media sheet or final receiving substrate, which normally is paper, to approach the glass transition temperature of between about 65° to about 70° C. and offset or melt onto the pressure roller. By carefully controlling the temperature of the fusing roller 49 to between about 130° C. and about 162° C. for all printing modes at about 55 millimeters per second to about 110 millimeters per second, and using the multi-functional oil on the fusing roller 49, the printer 10 can have successful imaging both in simplex and duplex printing and still avoid remelting or smudging the first side or simplex imaged media sheet 29 during the duplex imaging step. The imaged first side of the media sheet is not affected during the duplex imaging step.

While the invention has been described above with references to specific embodiments thereof, it is apparent that many changes, modifications and variations in the materials, arrangements of parts and steps can be made without departing from the inventive concept disclosed herein. Accordingly, the spirit and broad scope of the appended claims is intended to embrace all such changes, modifications and variations that may occur to one of skill in the art upon a reading of the disclosure. All patent applications, patents and other publications cited herein are incorporated by reference in their entirety.

Having thus described the invention, what is claimed is:

1. In an electrophotographic fusing system for use in a printer in duplex printing where imaging is accomplished with at least one toner, the toner having a characteristic cold offset temperature in specific printing modes, the fusing sytem comprising:

a heated fusing roller connected to the printer along a path of travel for media that is imaged with the toner, the heated fusing roller being coated with a mixture of functional polymeric release agents to lower fusing temperatures; and a pressure roller connected to the printer and forming a fusing nip with the fusing roller, the pressure roller having a temperature during operation of at least 5° C. below the cold offset temperature of the toner in a specific printing mode without the use of a separate cooling device.

2. The fusing system according to claim 1 wherein the mixture of functional polymeric release agents comprises an amino mercapto silicone oil blend.

3. The fusing system according to claims 1 or 2 wherein the temperature of the heated fusing roller during operation and duplex printing is between about 130° C. to about 162° C. at about 55 millimeters per second to about 110 millimeters per second processing speed.

4. A method of duplex printing a sheet of media in an electrophotographic printer having at least one toner that has a characteristic cold offset temperature in specific printing modes comprising the steps of:

simplex imaging a first side of a sheet of media with toner;

heating a fuser roller to a first temperature, the fuser roller being coated with a mixture of functional polymeric release agents to lower the first temperature;

passing the simplex imaged sheet of media between a pressure roller and the heated fuser roller to fuse an image to the first side of the sheet of media;

imaging a second side of the sheet of media with toner to form a duplex imaged sheet of media; and passing the duplex imaged sheet of media between the pressure roller and the heated fuser roller to fuse a second image to the second side of the sheet of media without affecting the simplex image on the first side of the sheet of media while maintaining a temperature of the pressure roller of at least about 5° C. below the cold offset temperature of the toner in a specific printing mode without the use of a separate cooling device.

5. The method according to claim 4 wherein the mixture of functional polymeric release agents comprise an amino mercapto silicone oil blend.

6. The method according to claims 4 or 5 further comprising maintaining the temperature of the fuser roller between about 130° C. and about 162° C. at about 55 millimeters per second to about 110 millimeters per second processing speed.

* * * * *